US006523248B1

(12) United States Patent
Snygg et al.

(10) Patent No.: US 6,523,248 B1
(45) Date of Patent: Feb. 25, 2003

(54) METHOD OF PRODUCING A MICROWAVE FILTER

(75) Inventors: Göran Snygg, Partille (SE); Sune Johansson, Växjö (SE); Bengt Svensson, Mölndal (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/613,556

(22) Filed: Jul. 10, 2000

(30) Foreign Application Priority Data

Jul. 9, 1999 (SE) ..... 9902638

(51) Int. Cl.[7] ..... H01Q 13/00; H01Q 13/10; H01P 3/12

(52) U.S. Cl. ..... 29/600; 29/602.1; 333/202; 333/212; 333/237; 343/770; 343/771

(58) Field of Search ..... 29/600, 602.1; 333/212, 206, 202, 237; 315/3.5, 3.6; 343/770, 771, 772

(56) References Cited

U.S. PATENT DOCUMENTS

| | | | | | |
|---|---|---|---|---|---|
| 4,349,798 | A | | 9/1982 | Podell et al. | |
| 4,578,620 | A | * | 3/1986 | James et al. | 315/3.5 |
| 4,586,009 | A | * | 4/1986 | James | 333/156 |
| 4,598,465 | A | * | 7/1986 | Cooper et al. | 29/600 |
| 4,619,041 | A | | 10/1986 | Davis et al. | |
| 5,231,330 | A | * | 7/1993 | Karsten | 315/3.5 |
| 5,446,430 | A | * | 8/1995 | Yamanaka et al. | 333/202 |
| 5,508,668 | A | * | 4/1996 | Pokkola | 333/202 |
| 5,588,198 | A | * | 12/1996 | Kawahata et al. | |
| 5,894,252 | A | * | 4/1999 | Oida | 333/202 |
| 5,929,567 | A | * | 7/1999 | Kang et al. | 315/5.39 |
| 5,929,728 | A | * | 7/1999 | Barnett et al. | 333/329 |
| 6,154,951 | A | * | 12/2000 | Ito et al. | 29/600 |
| 6,285,335 | B1 | * | 9/2001 | Swygg et al. | 343/770 |

FOREIGN PATENT DOCUMENTS

| | | | | |
|---|---|---|---|---|
| JP | 05167321 A | * | 7/1993 | 29/600 |
| SU | 1334226 A1 | | 9/1985 | |

* cited by examiner

*Primary Examiner*—Carl J. Arbes
*Assistant Examiner*—Minh Trinh
(74) *Attorney, Agent, or Firm*—Nixon & Vanderhye P.C.

(57) ABSTRACT

The invention relates to a method for producing a microwave filter (700), comprising making at least one through-cutout (750) in a first electrically conductive plate (740) shaped as a rectangle, with a short side and a long side, inserting the first plate (740) between a second (710) and a third (730) electrically conductive plate (710), the first plate being arranged parallel to the second and the third plate, making electrical connections (794, 795) between said three plates for interconnecting those edge surfaces on the plates which coincide with the direction of propagation of the electrical signals, as a result of which a space comprising one or more cavities is formed. The first plate (740) is arranged so that the extent of its short side coincides with the E-field of the microwave signals when they propagate in the filter (700), and the extent of its long side coincides with the direction of propagation of the electrical signals.

11 Claims, 5 Drawing Sheets

METHOD OF PRODUCING A MICROWAVE FILTER

TECHNICAL FIELD

The present invention relates to a method of producing a filter for electromagnetic microwave signals.

The invention also relates to a filter for electromagnetic microwave signals. The filter comprises a first, second and third conductive plate, the first plate being arranged between the other two, and the first plate having a through-cutout. The plates are connected to one another by electrically conductive connections which interconnect those edge surfaces on the plates which coincide with the direction of propagation of the electrical signals, as a result of which a space is formed, which, in the direction of propagation of the signals, is enclosed by electrically conductive surfaces.

BACKGROUND ART

In the production of microwave filters, it is usual to make use of, for example, waveguide structures which are provided with what are known as trimming screws. By means of the trimming screws, the waveguide structure is adjusted so that it has the desired filter characteristic.

Adjustment by means of trimming screws is a time-consuming and costly procedure, which is of course a disadvantage. Furthermore, this technique makes it difficult to give the filter the desired performance, and increased filter losses and a rounder filter characteristic than desired are usually obtained.

U.S. Pat. No. 3,925,883 discloses a waveguide arrangement which is produced by means of bending a metal plate which is then joined together with another plate, and a waveguide flange which is constructed from plates with spaces. It would appear that the technique used to construct a waveguide flange according to this document cannot be used to construct structures which have an arbitrarily long extent in the direction of propagation of the signals. Moreover, the document does not disclose any microwave filters.

SU 1334226 discloses a millimeter band waveguide apparatus, with a waveguide channel formed by cutting a hole in a metal plate, said metal plate then being secured between two other metal plates, both of which are solid. The thickness of the metal plate in which a hole has been made defines one of the dimensions of the waveguide channel, and in addition, the two main planes of extension of said metal plate coincide with the H-plane of the electromagnetic field of the electromagnetic waves which will propagate in the device, and with the direction of propagation of said electromagnetic waves respectively.

DISCLOSURE OF THE INVENTION

The problem solved by the present invention is therefore that of providing a method for producing a microwave filter, which is rapid and inexpensive and produces a filter with better performance than previously known art.

This problem is solved by means of a method of producing a filter for electromagnetic microwave signals which, when they are propagated in the filter, have an E-field, an H-field and a direction of propagation, which method comprises making at least one through-cutout in a first electrically conductive plate, which plate has a first and a second main plane of extent, and is shaped as a rectangle, with a short and a long side. The first electrically conductive plate is inserted between a second electrically conductive plate and a third electrically conductive plate, which plates likewise have a first and a second main plane of extent.

The first electrically conductive plate is arranged parallel to the second and third plate, and electrically conductive connections are made between said three plates. These connections interconnect those edge surfaces on the plates which coincide with the direction of propagation of the electrical signals, as a result of which a space is formed, which, in the direction of propagation of the signals, is enclosed by electrically conductive surfaces.

The first conductive plate is arranged so that the extent of its short side coincides with the E-field of the microwave signals when they are propagated in the filter, and so that the extent of its long side coincides with the direction of propagation of the electrical signals.

Another method provided by the invention relates to the production of a filter for electromagnetic microwave signals which, when they are propagated in the filter, have an E-field, an H-field and a direction of propagation, said method comprising making at least one through-cutout in each of a first and a fourth electrically conductive plate which both have a first and a second main plane of extent, and which both are shaped as a rectangle, with a short side and a long side, and inserting the first and the fourth electrically conductive plates between a second electrically conductive plate and a third electrically conductive plate, which plates likewise have a first and a second main plane of extent, the first and the fourth plates being arranged parallel to the second and the third plate.

According to this method, electrically conductive connections are made between said four plates, which connections interconnect those edge surfaces on the plates which coincide with the direction of propagation of the electrical signals, as a result of which a space comprising one or more cavities is formed, which, in the direction of propagation of the signals, is enclosed by electrically conductive surfaces.

The first and fourth plates are arranged so that the extent of their short sides coincides with the H-field of the microwave signals when they are propagated in the filter and the extent of their long sides coincides with the direction of propagation of the electrical signals, and the thickness of the first and fourth plates together define the height of said one or more cavities.

By means of the invention, a microwave filter can therefore be constructed in a rapid and cost-effective manner. A great many plates with cutouts of different shape can be prefabricated, and, for production of a filter which is to have a certain desired characteristic, the plate which provides precisely the desired characteristic is selected as the first conductive plate. According to the invention, this plate is inserted between other prefabricated plates which are preferably cover plates. The plates are interconnected electrically, and a filter with the desired characteristic is obtained in a rapid and cost-effective manner, without it being necessary to carry out any trimming.

Another problem solved by the present invention is that of providing a microwave filter which can be produced rapidly and simply and has better performance than previously known microwave filters.

This problem is solved by means of a filter for electromagnetic microwave signals which, when they are propagated in the filter, have an E-field, an H-field and a direction of propagation, which filter comprises a first electrically conductive plate which has a first and a second main plane of extent, is shaped as a rectangle with a short side and a long side, and has at least one through-cutout. The filter also has a second electrically conductive plate and a third electrically conductive plate, which plates likewise have a first and a second main plane of extent. The first plate is arranged between and parallel to the other two plates.

The three plates are electrically connected to one another by means of connections which connect those edge surfaces on the plates which coincide with the direction of propagation of the electrical signals. In this manner, the filter is made to comprise a space which, in the direction of propagation of the signals, is enclosed by electrically conductive surfaces. The first conductive plate is arranged so that the extent of its short side coincides with the E-field of the microwave signals when they are propagated in the filter, and its second main plane of extent coincides with the direction of propagation of the electrical signals.

In addition, the invention also comprises a filter for electromagnetic microwave signals which, when they are propagated in the filter, have an E-field, an H-field and a direction of propagation, which filter comprises a first and a fourth electrically conductive plate, each of which have a first and a second main plane of extent, and both of which are shaped as a rectangle with a short side and a long side, and have at least one through-cutout each. In addition, the filter comprises a second electrically conductive plate and a third electrically conductive plate which plates likewise have a first and a second main plane of extent, between and parallel to which plates the first and the fourth plates are arranged, and electrically conductive connections between said four plates, which interconnect those edge surfaces on the plates which coincide with the direction of propagation of the electrical signals, as a result of which the filter is made to comprise a space comprising one or more cavities, which, in the direction of propagation of the signals, is enclosed by electrically conductive surfaces. The first and fourth conductive plates are arranged so that the extent of their short sides coincide with the H-field of the microwave signals when they are propagated in the filter, and the extent of their long sides coincides with the direction or propagation of the electrical signals, so that the thickness of the first and fourth plates together define the height of said one or more cavities.

BRIEF DESCRIPTION OF THE DRAWINGS

The invention is described in greater detail below by means of exemplary embodiments and with reference to the appended drawings, in which.

EMBODIMENTS

Figure 1:
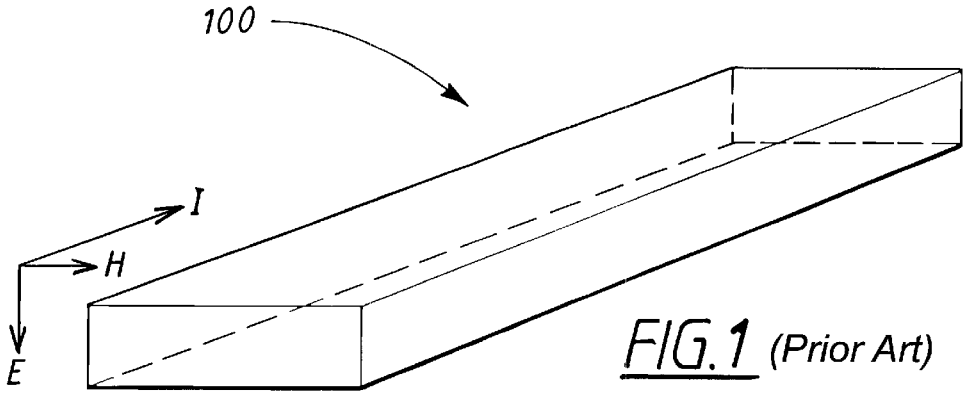
FIG. 1 (Prior Art)
FIG. 1 shows the reference directions used in the description.

FIG. 1 shows a rectangular waveguide structure 100 of conventional type. The structure 100 is used to illustrate the reference directions which are to be used in the description below. An electrical signal is propagated in the waveguide structure 100 in a certain direction of propagation I which coincides with the longitudinal direction of the waveguide. In a cross section at right angles through the direction of propagation of the waveguide, the electrical signal has an E-field and an H-field in a manner well known to the person skilled in the art.

Figure 2:
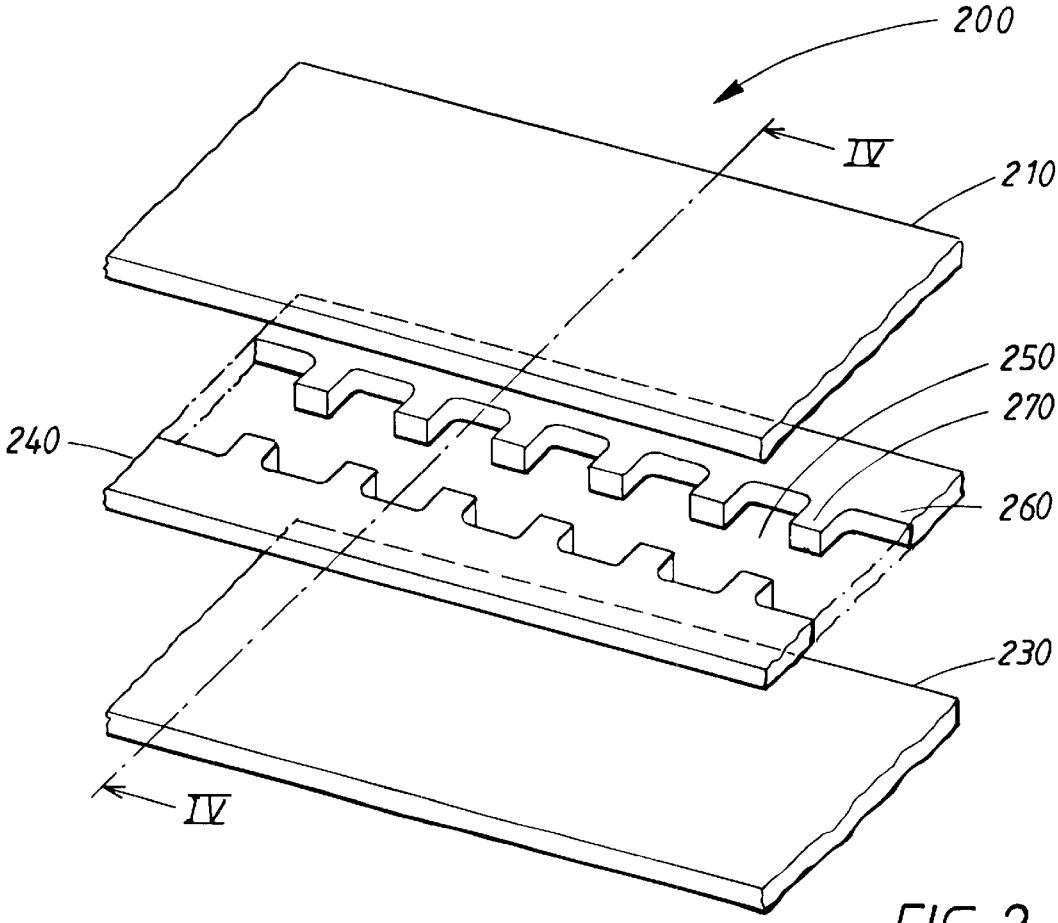
FIG. 2 shows an exploded diagram of a portion in the longitudinal direction of a filter produced by means of a method according to the invention.

FIG. 2 shows an exploded diagram of a portion in the longitudinal direction of a filter produced by means of a method according to the invention. In a first electrically conductive plate 240 with a first and a second main plane of extent, a cutout 250 has been made, which goes right through the plate. This cutout 250 can be made in a great many different ways. The cutout is suitably made by means of punching, but, among other possible methods, mention may be made of various types of cutting machining, for example laser cutting, milling or etching.

By adapting the design of the cutout 250, the microwave filter being produced can be imparted the desired electrical properties. The cutout can be designed in an on the whole optional manner, as a result of which a great many different types of filter can be produced. In a preferred embodiment, the cutout 250 is designed so that it comprises at least two larger rectangular part cutouts 260 connected to a smaller rectangular part cutout 270. The smaller part cutouts mean that portions of the plate 240 are formed, which project into the cutout 250, what are known as irises. By means of this design of the cutout 250, the filter has essentially only inductive properties.

As can be seen from FIG. 2, the first conductive plate 240 is arranged between and parallel to the second plate 210 and the third plate 230. The second and third plates have a first and a second main plane of extent.

Furthermore, the first electrically conductive plate is arranged in such a manner that its one main plane of extent coincides with the H-field of the electrical signal which is intended to be propagated in the filter, and its other main plane of extent coincides with the direction of propagation of the electrical signal, according to the definitions of these directions as shown in FIG. 1.

Electrical connections are made between the three plates, which is carried out in this embodiment by the plates being joined together with one another in a structure in which they are "stacked" one on another. The joining together can be carried out in various ways which are well-known per se to the person skilled in the art and will therefore not be described in greater detail here, but, in a preferred embodiment, the joining together is carried out by means of soldering, preferably soft soldering. Other possible methods of joining the plates together are gluing or screws.

When the plates in the filter have been joined together, the cutout 250 in the first plate is consequently enclosed by conductive surfaces of the first (the side walls in the cutout), second and third plates, as a result of which a space comprising one or more cavities formed by the part cutouts 260, 270 is formed in the filter, which space, in the direction of propagation of the signals, is enclosed by electrically conductive surfaces. In other words, the filter in this embodiment of the invention constitutes what is known as a cavity filter.

A microwave filter according to the invention is preferably connected to other components via separate connection surfaces. These can be located on, for example, the short sides of the filter, in other words the delimiting surfaces of the filter in its longitudinal direction, and are not shown in FIG. 2.

Figure 3:
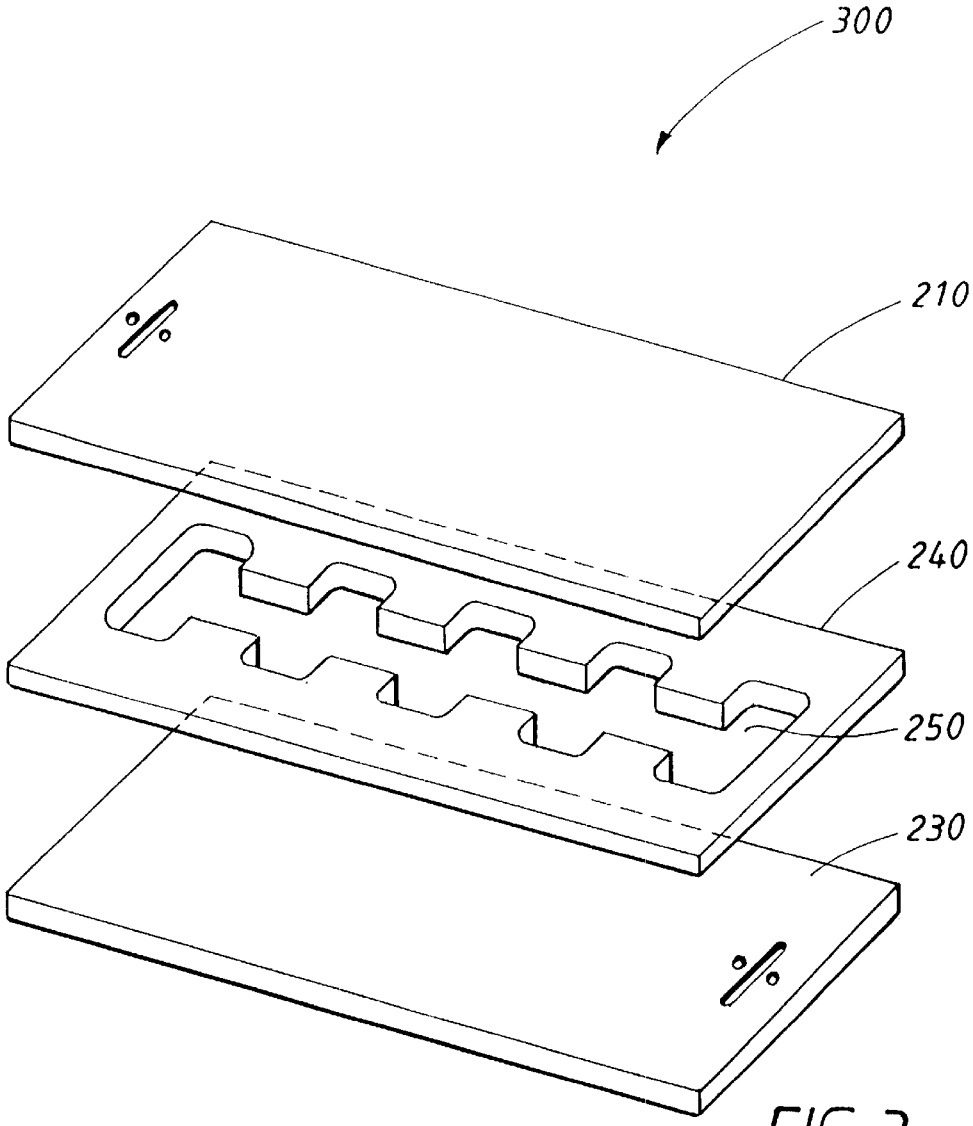
FIG. 3 shows an exploded diagram of another filter produced by means of a method according to the invention.

FIG. 3 shows an exploded diagram of a filter according to the invention, in which use is made of another method of arranging connections to a microwave filter according to the invention. The connections can, as shown diagrammatically in FIG. 3, consist of apertures in the second plate 210 and the third plate 230, in which case it is suitable if the cutout 250 in the first electrically conductive plate is contained entirely within the plate 240.

Figure 4:
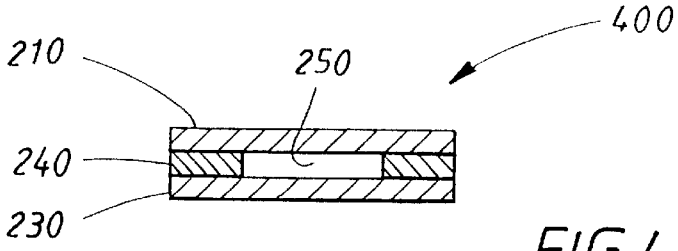
FIG. 4 shows the contour of a filter produced according to the invention, in a cross section in the longitudinal direction.

FIG. 4 shows, in a cross section along the line IV—IV in FIG. 2, the contour of a filter produced according to the invention, with the same reference numbers as in FIG. 2. It can seen from FIG. 4 that the plates have been "stacked" one on another, with the first plate 240 inserted between the second plate 210 and the third plate 230. FIG. 4 also illustrates how the cutout 250 in an arrangement produced according to the invention forms a space which, in the direction of propagation of the electrical signals, is enclosed by electrically conductive surfaces.

Figure 5:
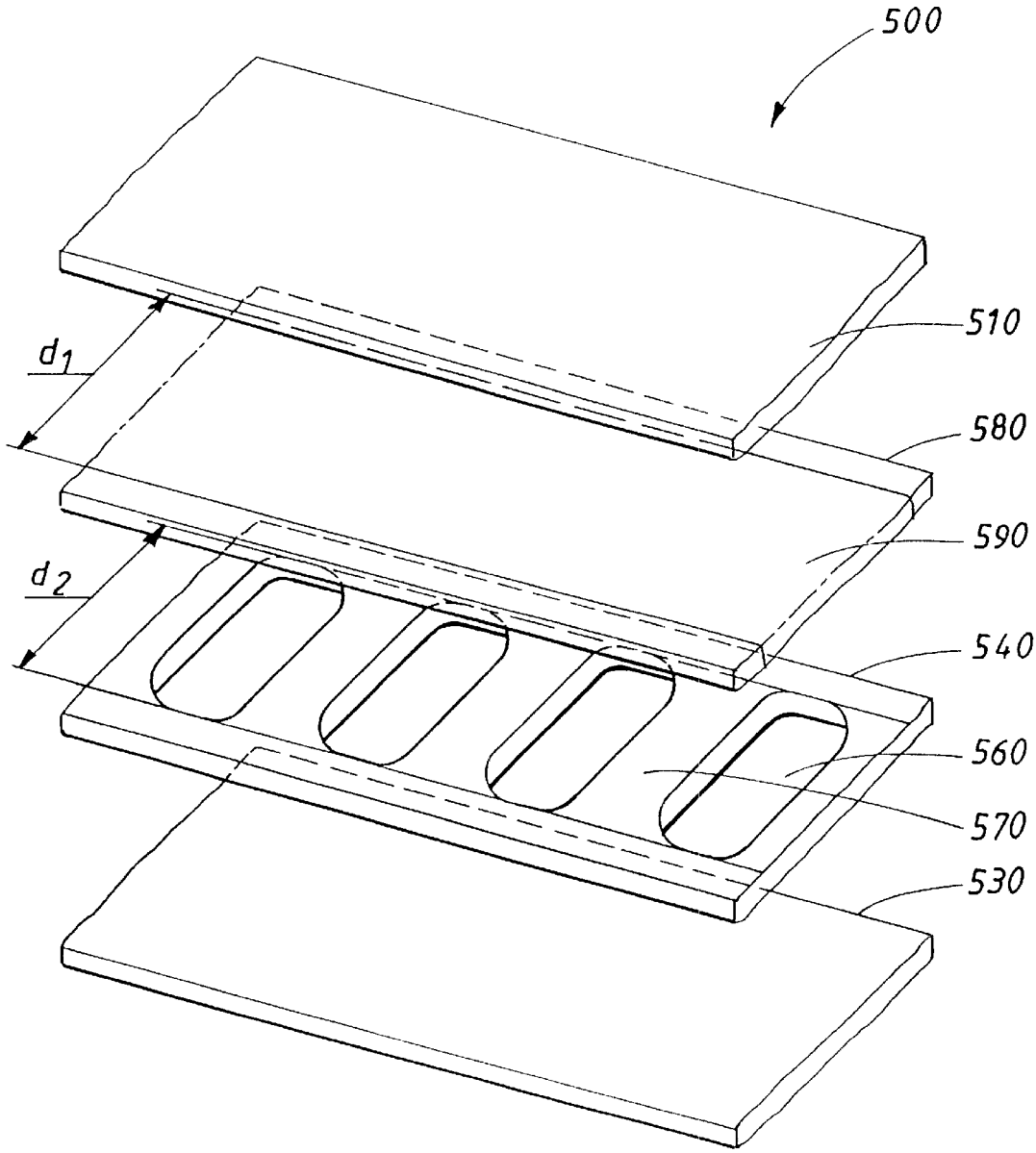
FIG. 5 shows an exploded diagram of a portion in the longitudinal direction of another variant of a filter produced by means of a method according to the invention.

FIG. 5 shows an exploded diagram of another variant of a microwave filter produced according to the invention. This variant of microwave filter, in contrast to the variant described in connection with FIGS. 2–4, has essentially only capacitive properties. This is achieved by virtue of the microwave filter 500 comprising a further conductive plate, a fourth plate 580, in addition to the plates comprised in the embodiments 200, 300, 400 described above. The fourth plate 580 has a first and a second main plane of extent, and is provided with an essentially rectangular through-cutout 590 which has its longitudinal direction in the direction of propagation of the signals.

The cutout 590 is preferably but not necessarily given an extent $d_1$ in the direction of the H-field which exceeds or coincides with the extent $d_2$ in the same direction of the part cutouts 560 in the first plate 540.

The first conductive plate 540 in this embodiment also has a design which differs somewhat from the corresponding first plate in the embodiments described above. The first plate 540 in this embodiment comprises one or more part cutouts 560 which are separated from one another in the longitudinal direction of the filter being produced by a number of irises 570. The irises 570 in the first plate in this embodiment differ from the irises in the embodiments described above in so far as they constitute connections between the sides of the first plate 540 in the H-plane in the filter being produced and thus separate completely two adjacent cutouts 560 in the plate from one another. The first plate 540 in this embodiment therefore has a structure which resembles a ladder.

What was stated above about the plates in the embodiments 200, 300 and 400 with regard to how these are joined together and extend in the longitudinal direction also applies to the embodiment 500 in FIG. 5 and is consequently not repeated here. However, the fourth plate 580 is also inserted between the second and third plates 530, 510, on either side of the first plate 540, so that one main plane of extent of the fourth plate coincides with the H-field of the electrical signal which is propagated in the filter, and its other main plane of extent coincides with the direction of propagation of the electrical signal.

When the filter 500 is joined together, a space comprising one or more cavities 560 is formed, which is enclosed by electrically conductive surfaces in the direction of propagation of the electrical signal. The irises 570 in this space will, in contrast to the irises in the embodiments 200, 300, 400, be in contact with either the third conductive plate 530 or the second conductive plate 510, depending on which side of the first plate 540 the fourth plate 580 is arranged on, which means that the filter 500 essentially only has capacitive properties.

Figure 6:
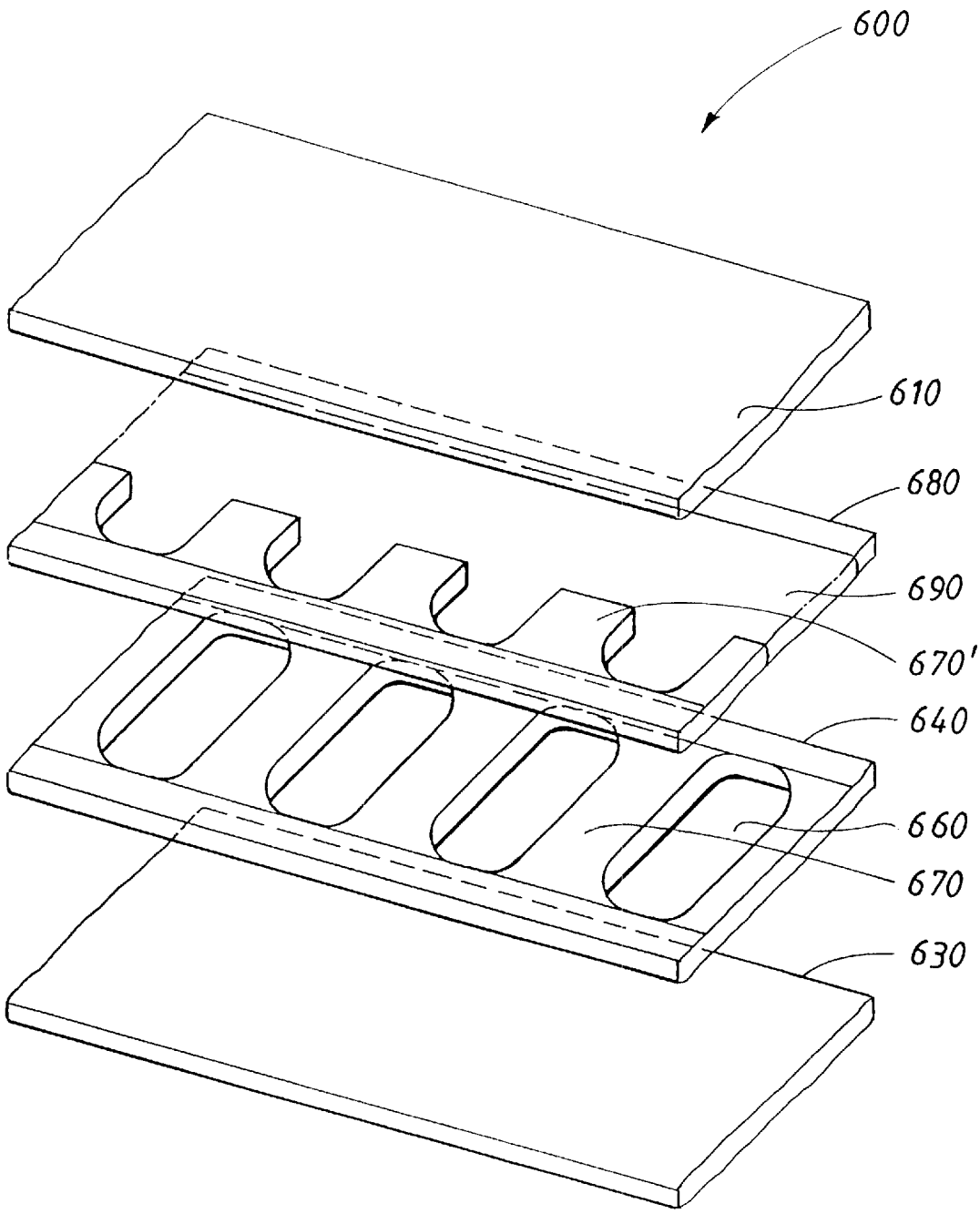
FIG. 6 shows an exploded diagram of a further variant of a filter produced according to the invention.

FIG. 6 shows a filter 600 according to the invention, which has both inductive and capacitive properties. This is achieved by virtue of the filter 600, like the filter 500, comprising four plates, the first 640, the second 610 and the third 630 being designed essentially like the corresponding plates in the filter 500, for which reason they will not be described again here.

The fourth conductive plate 680 in the filter 600 has a different design from the fourth conductive plate in the filter 500. In the filter 600, the fourth conductive plate 680 comprises a through-cutout 690 and a number of inwardly projecting portions of the plate 680, irises 670', which differ in their design from the irises 670 in the first plate 640 of the filter. The irises 670' in the fourth plate 680 extend from one of the sides of the fourth plate in the H-direction in the filter being produced towards the other of the sides of the fourth plate in the same direction but have a shorter extent in this direction than the cutout 690 and therefore do not connect the sides of the fourth plate 680 in the H-direction in the filter being produced.

When the filter 600 is joined together, a space comprising one or more cavities 660 is formed, which is enclosed by electrically conductive surfaces in the direction of propagation of the electrical signal.

Figure 7:
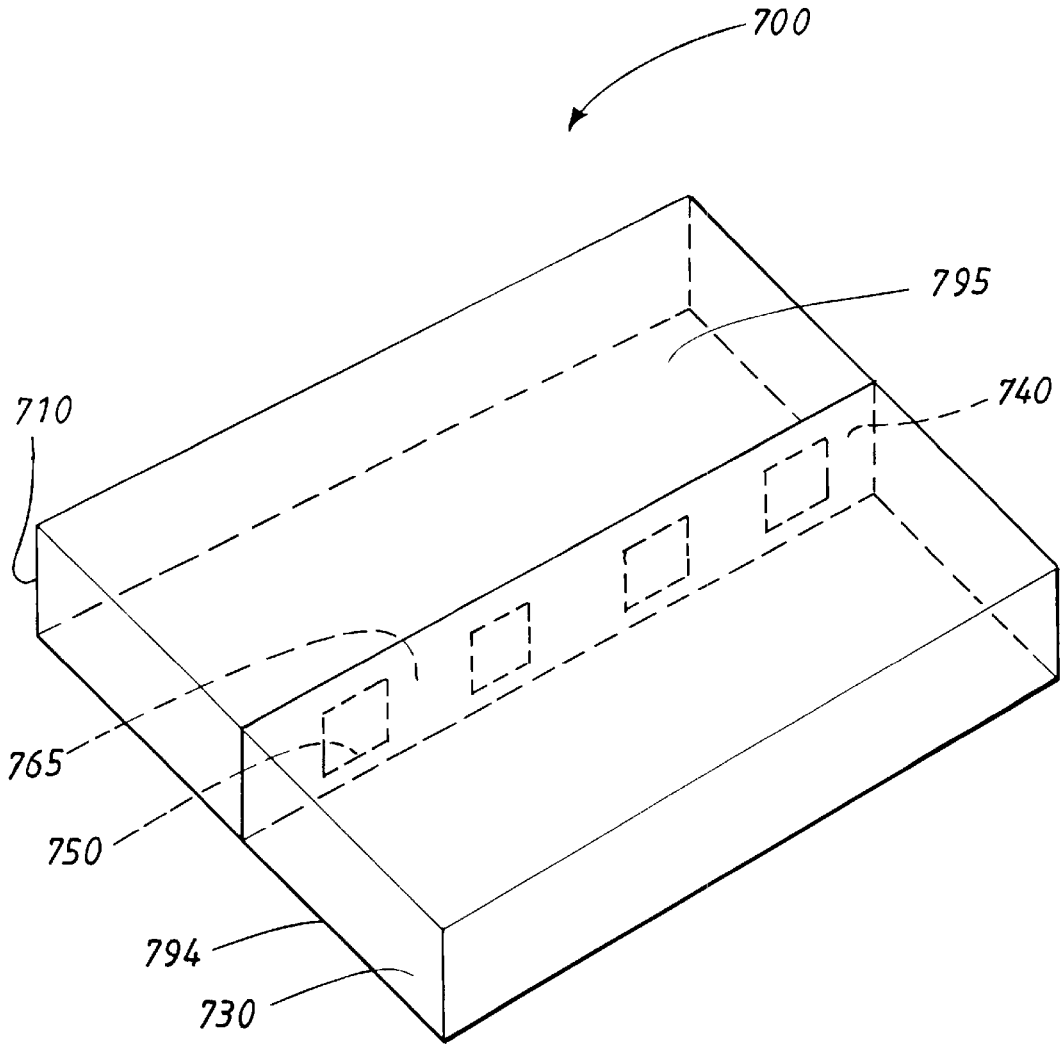
FIG. 7 shows an alternative filter produced according to the invention.

FIG. 7 shows a portion in the longitudinal direction of an alternative embodiment of a microwave filter 700 produced according to the invention. The filter 700 is what is known as an E-plane filter and comprises, like the embodiments of the invention described above, a first electrically conductive plate 740 which has a first and a second main plane of extent. At least one through-cutout 750, which is preferably rectangular, is made in the first electrically conductive plate 740. In a preferred embodiment, a number of through-cutouts 750 are made, arranged in a row next to one another in the first plate, in the direction of propagation of the electrical signal.

The first plate 740 is inserted between a second electrically conductive plate 710 and a third electrically conductive plate 730, which plates have a first and a second main plane of extent. The first conductive plate is arranged between the second and the third plate so that it is parallel to these and so that its first main plane of extent coincides with the E-field of the microwave signals when they are propagated in the filter and its second main plane of extent coincides with the direction of propagation of the electrical signals.

According to the invention, electrically conductive connections are made between said three plates, which connections interconnect those edge surfaces on the plates which coincide with the direction of propagation of the electrical signals. In this embodiment of the invention, the electrically conductive connections between said edge surfaces consist of a lower, fourth, conductive plate 794, and an upper, fifth, conductive plate 795.

In this manner, a space comprising one or more cavities is formed, which, in the direction of propagation of the signals, is enclosed by electrically conductive surfaces. In this embodiment, the first conductive plate 740 is enclosed in said space, and the cavities in the space comprise the cutouts 750 in the first electrically conductive plate.

An alternative method of constructing an E-plane filter according to the invention is to make the fourth plate 794 and the fifth plate 795 each consist of two part plates which together form the fourth and the fifth plate respectively.

These part plates are preferably divided along an imaginary centre line in the fourth and fifth plate respectively, which centre line essentially coincides with the position of the first plate 740 on the fourth and the fifth plate respectively. These part plates are arranged one on each side of the first conductive plate, between the first and the second plate and, respectively, between the first and the third plate, after which joining together is carried out.

The invention consequently provides a method for rapidly and cost-effectively producing different types of microwave filter with different electrical properties. The electrical properties of the filter are defined essentially by the design of the plate which is selected as the first conductive plate 240, 540, 640, 740. Furthermore, a microwave filter according to the invention can in principle be of optional length with unchanged electrical properties, which is also an advantage.

As far as selection of the material for the conductive plates is concerned, it is aluminium in a preferred embodiment, but other metals, such as, for example, copper, are also possible. Another possibility is to use plates made of metallized plastic, in other words any material with sufficiently great conductivity can be used.

The invention is not limited to the exemplary embodiments described above but can be varied freely within the scope of the patent claims below. For example, it is possible for one or more of the cutouts or part cutouts described above to have a different design from those described, for example a circular shape, in order to achieve other types of filter property. It is also possible, of course, for one or more adjacent plates of the plates described above to be designed as a common plate.

The invention can also be applied to the construction of a filter which consists of, in principle, any number of plates.

What is claimed is:

1. Method of producing a filter for electromagnetic microwave signals which, when the electromagnetic microwave signals are propagated in the filter, have an E-field, an H-field and a direction of propagation, the method comprising:

making at least one through-cutout in a first electrically conductive plate which has a first and a second main plane of extent, and wherein the first electrically conductive plate is shaped as a rectangle and has a short side and a long side each extending in a plane of the first electrically conductive plate, inserting the first electrically conductive plate between a second electrically conductive plate and a third electrically conductive plate, which second and third electrically conductive plates each have a first and a second main plane of extent, so that the first electrically conductive plate is parallel to the second and the third electrically conductive plates, making electrically conductive connections between said first, second and third electrically conductive plates, which connections interconnect edge surfaces of the first, second and third electrically conductive plates which coincide with the direction of propagation of the electrical signals, as a result of which a space comprising one or more cavities is formed, which, in the direction of propagation of the signals, is enclosed by electrically conductive surfaces, and orienting the first electrically conductive plate so that the extent of the short side of the first electrically conductive plate coincides with the E-field of the electromagnetic microwave signals when the electromagnetic microwave signals are propagated in the filter, and the extent of the long side of the first electrically conductive plate coincides with the direction of propagation of the electromagnetic microwave signals.

2. Method according to claim 1, according to which the cutout in the first conductive plate is designed as a rectangle.

3. Method according to claim 1, in which the electrically conductive connections between said first, second and third electrically conductive plates are formed by an upper electrically conductive plate and a lower electrically conductive plate.

4. Method of producing a filter for electromagnetic microwave signals which, when the electromagnetic microwave signals are propagated in the filter, have an E-field, an H-field and a direction of propagation, the method comprising:

providing first, second, third and fourth electrically conductive plates;

making at least one through-cutout in each of the first and fourth electrically conductive plates, each of the first and fourth electrically conductive plates having a first and a second main plane of extent, and wherein each of the first and fourth electrically conductive plates are shaped as a rectangle with a short side and a long side, inserting the first and the fourth electrically conductive plates between the second electrically conductive plate and the third electrically conductive plate, the second and third electrically conductive plates each having a first and a second main plane of extent, so that the first and the fourth electrically conductive plates are parallel to the second and third electrically conductive plates, making electrically conductive connections between said first, second, third and fourth electrically conductive plates, which connections interconnect edge surfaces of the first, second, third and fourth electrically conductive plates which coincide with the direction of propagation of the electromagnetic microwave signals, as a result of which a space comprising one or more cavities is formed, which, in the direction of propagation of the signals, the space is enclosed by electrically conductive surfaces, and orienting the first and fourth electrically conductive plates so that the extent of the short sides of the first and fourth electrically conductive plates coincides with the H-field of the electromagnetic microwave signals when the electromagnetic microwave signals are propagated in the filter and the extent of the long sides of the first and fourth electrically conductive plates coincides with the direction of propagation of the electromagnetic microwave signals, and a combined thickness of the first and fourth electrically conductive plates defines the height of said one or more cavities.

5. Method according to claim 4, according to which the cutout made in the first electrically conductive plate comprises at least two part cutouts.

6. Method according to claim 5, according to which the at least two part cutouts are two larger part cutouts connected via a smaller part cutout.

7. Method according to claim 4, according to which the cutout in the fourth plate is essentially rectangular and has its longitudinal direction in the direction of propagation of the signals.

8. Method according to claim 4, according to which the cutout in the fourth plate is essentially rectangular and comprises a number of irises which extend from one of the sides of the fourth plate in the H-direction in the filter being produced towards the other of the sides of the fourth plate in the same direction.

9. Method according to claim 4, in which the electrically conductive connections between the plates included in the filter are brought about by virtue of the plates being joined together by means of soldering.

10. Method according to claim 4, in which the electrically conductive connections between the plates included in the filter are brought about by virtue of the plates being joined together by means of gluing.

11. Method according to claim 4, in which the electrically conductive connections between the plates included in the filter are brought about by virtue of the plates being joined together by means of screws.

* * * * *